United States Patent [19]

Meier

[11] Patent Number: 4,606,173

[45] Date of Patent: Aug. 19, 1986

[54] METHOD AND APPARATUS FOR THE INTERMEDIATE STORAGE OF PRINTED PRODUCTS ARRIVING IN AN IMBRICATED PRODUCT FORMATION

[75] Inventor: Jacques Meier, Bäretswil, Switzerland

[73] Assignee: Ferag AG, Hinwil, Switzerland

[21] Appl. No.: 616,676

[22] Filed: Jun. 4, 1984

[30] Foreign Application Priority Data

Jun. 9, 1983 [CH] Switzerland ..... 3160/83

[51] Int. Cl.[4] ..... B65B 63/04; B65H 29/70

[52] U.S. Cl. ..... 53/430; 53/118; 271/204; 271/902; 242/59; 414/29

[58] Field of Search ..... 198/447, 402; 53/430, 53/118, 593, 587, 556, 441, 211, 212, 214; 271/151, 202, 216, 303, 204, 206, 300, 902; 414/29, 32, 57, 68; 242/59, 67.2, 67.3 R, 67.4, 55, DIG. 2; 270/52, 54, 56, 52.5; 206/390, 412

[56] References Cited

U.S. PATENT DOCUMENTS

| | | | |
|---|---|---|---|
| 1,902,312 | 3/1933 | Rous | 206/412 |
| 3,488,917 | 1/1970 | Oswald et al. | 414/29 X |
| 4,010,945 | 3/1977 | Kistner | 271/255 X |
| 4,039,182 | 8/1977 | Reist et al. | 271/204 X |
| 4,214,743 | 7/1980 | Meier | 271/902 X |
| 4,438,618 | 3/1984 | Honegger | 414/29 X |
| 4,509,703 | 4/1985 | Grunder | 271/204 X |

FOREIGN PATENT DOCUMENTS

| | | | |
|---|---|---|---|
| 3130945 | 4/1982 | Fed. Rep. of Germany . | |
| 2092557 | 2/1981 | United Kingdom | 242/59 |

*Primary Examiner*—Horace M. Culver

*Attorney, Agent, or Firm*—Werner W. Kleeman

[57] ABSTRACT

An imbricated product subformation is formed from one half of the printed products delivered in an imbricated product formation by a conveyor or transporter. This subformation is guided through a deflection or turning device. The printed products are accelerated and separated or singled as they run through this deflection or turning device and are simultaneously inverted. After leaving the deflection or turning device, the printed products are conveyed against a fixed stop member and are then deposited upon a belt conveyor to form a new imbricated product subformation. A second subformation is formed from the other half of the arriving printed products and is deposited upon the first altered subformation and is then conjointly wound up with this first altered subformation to form a coil or wound product package. By dividing the initially arriving imbricated product formation into two subformations and subsequently reuniting these subformations, the winding operation can take place at a speed which is only half as great as the delivery speed of the initially arriving imbricated product formation.

23 Claims, 4 Drawing Figures

22
20
K
19
18
17
20'
S3
16
1
1a
1b
1'
S2
2
3
21
21a
S1
16a
15

METHOD AND APPARATUS FOR THE INTERMEDIATE STORAGE OF PRINTED PRODUCTS ARRIVING IN AN IMBRICATED PRODUCT FORMATION

CROSS REFERENCE TO A RELATED APPLICATION

This application is related to the co-pending and commonly assigned U.S. patent application Ser. No. 616,677, filed 6/4/84, and entitled "Method and Apparatus for the Intermediate Storage of Printed Products Arriving in Imbricated Product Formation such as Newspapers, Periodicals and the Like".

This application is also related to the co-pending and commonly assigned U.S. patent application Ser. No. 06/445,565, filed Nov. 29, 1982, and entitled "Method and Apparatus for Storing Continuously Arriving Flat Products, Especially Printed Products, and Product Package Formed from such Products".

BACKGROUND OF THE INVENTION

The present invention broadly relates to the intermediate storage of printed products or the like and, more specifically, pertains to a new and improved method and apparatus for the intermediate storage of printed products arriving in an imbricated product formation or stream, such as newspapers, periodicals and the like.

Generally speaking, the method of the present invention for the intermediate storage of printed products arriving in an imbricated product formation, such as newspapers, periodicals and the like, comprises the steps of conveying the printed products to a winding mandril, preferably from below, and winding the printed products conjointly with a winding band maintained under tension and operatively connected with the winding mandril upon such winding mandril.

The apparatus of the present invention for the intermediate storage of printed products arriving in an imbricated product formation or stream comprises a rotatably journaled and rotatably driveable winding mandril for winding up the printed products, a conveyor device for delivering the printed products, preferably from below, to the winding mandril, and a winding band or strap capable of being placed under tension and operatively connected with the winding mandril for being entrained between coil layers of a coil or wound package of printed products being wound up.

It is known, for instance from the U.S. Pat. No. 4,438,618, granted Mar. 27, 1984, and the corresponding British Patent Publication No. 2,081,230, to wind up printed products arriving in an imbricated product formation upon a winding mandril or core. Since the circumferential speed of the winding mandril or core, respectively of the coil or wound product package forming thereupon, must correspond to the delivery speed of the imbricated product formation, the circumferential speed of the coil or wound product package being formed assumes relatively high values at high delivery rates of the printed products and the ensuing high delivery speeds thereof. The high circumferential speed of the coil or wound product package being formed leads to correspondingly high centrifugal forces.

Since the imbricated product formation is delivered to the winding mandril conjointly with a winding band or strap in so-to-speak "underfeed", that is with the leading edges of the printed products closer to the axis of rotation of the winding mandril than the trailing edges, the printed products are deposited with their leading edges adjacent to or in contact with the coil or wound package. This measure assures that each inner layer of the coil or package can be further rotated in the winding direction of the coil or package in relation to the next outer layer. It is therefore possible to further rotate or wind up the coil or package from the interior in the manner of a clock spring and to thereby compact the product coil or wound package.

SUMMARY OF THE INVENTION

Therefore, with the foregoing in mind it is a primary object of the present invention to provide a new and improved method and apparatus for the intermediate storage of printed products arriving in an imbricated product formation which do not have associated therewith the aforementioned drawbacks and shortcomings of prior art constructions.

Another and more specific object of the present invention aims at providing a new and improved method and apparatus of the previously mentioned type which permits the formation of a very compact coil or wound product package by simple means and with a reduction of loading of the winding apparatus and of the coil or wound product package forming thereupon.

Yet a further significant object of the present invention aims at providing a new and improved apparatus of the character described which is relatively simple in design, extremely economical to realize, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the features that it comprises the steps of dividing the arriving imbricated product formation of printed products into two imbricated product subformations, altering the position of the printed products in one of the two imbricated product subformations such that edges of the printed products which trailed in the arriving imbricated product formation become leading edges in the one altered imbricated product subformation, mutually superposing the two imbricated product subformations, subsequently winding up the two superposed imbricated product subformations conjointly such that the one altered imbricated product subformation is outermost in relation to the winding mandril and the altered leading edges, which were trailing edges in the arriving imbricated product formation, lie on a side of the one altered imbricated product subformation and which side is nearer to the winding mandril.

The apparatus of the present invention is manifested by the features that it comprises a device or means for dividing the arriving imbricated product formation into two imbricated product subformations and a further device or means for subsequently superposing the two imbricated product subformations and which devices are located upstream or forwardly of the conveyor device. There is further provided a position-altering device for altering the position or orientation of the printed products in a predetermined one of the two imbricated product subformations which is more remote from the winding mandril, i.e. the axis of rotation thereof, such that edges of the printed products which were trailing edges in the arriving imbricated product formation become leading edges which lie upon that side of the altered imbricated product subformation nearer to the winding mandril.

By dividing or splitting up the initially arriving or delivered imbricated product formation into two subformations which are, after an alteration of the position or orientation of the printed products in one of the two subformations, deposited one upon the other and then conjointly wound up, the effect is achieved that the winding speed, i.e. the circumferential speed of the coil or wound product package being formed, is only half as great as the transport speed of the arriving imbricated product formation. Altering the position or orientation of the printed products in the outer, i.e. in the lower of the two superposed subformations, before winding up permits each coil layer formed from the two superposed subformations to be further rotated in the direction of winding with respect to a next outer coil layer of the coil or wound product package being formed without any mutual blocking or interference of the printed products. In this way it is possible to further rotate the coil or wound product package being formed from the interior thereof in the manner of a clock spring and to thus compact the coil or wound product package.

In the compact coil or wound product package formed in this manner, the coil layers of the printed products are firmly pressed and are therefore greatly compressed in the radial direction and lie closely upon one another. The alteration of the position or orientation of the printed products in the one subformation, which is a prerequisite for the aforedescribed formation of a compact coil or wound product package and furthermore permits readily regaining an imbricated product formation in which the printed products have the same position or orientation as in the original imbricated product formation when unwinding later, can be performed with relatively simple equipment or structure and in a flawless manner not subject to malfunction.

The printed products of that imbricated product subformation in which the position or orientation of such products is to be altered are preferably divided into at least two imbricated product branch streams before the position or orientation of the printed products in each such imbricated product branch stream is altered in the manner described above. After this position-alteration, the imbricated product branch streams are reunited into an imbricated product subformation. This division of one of the imbricated product subformations permits the position-alteration of the printed products to be performed at a speed which is appreciably lower than the delivery speed of the arriving imbricated product formation or stream, that is, four times lower.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
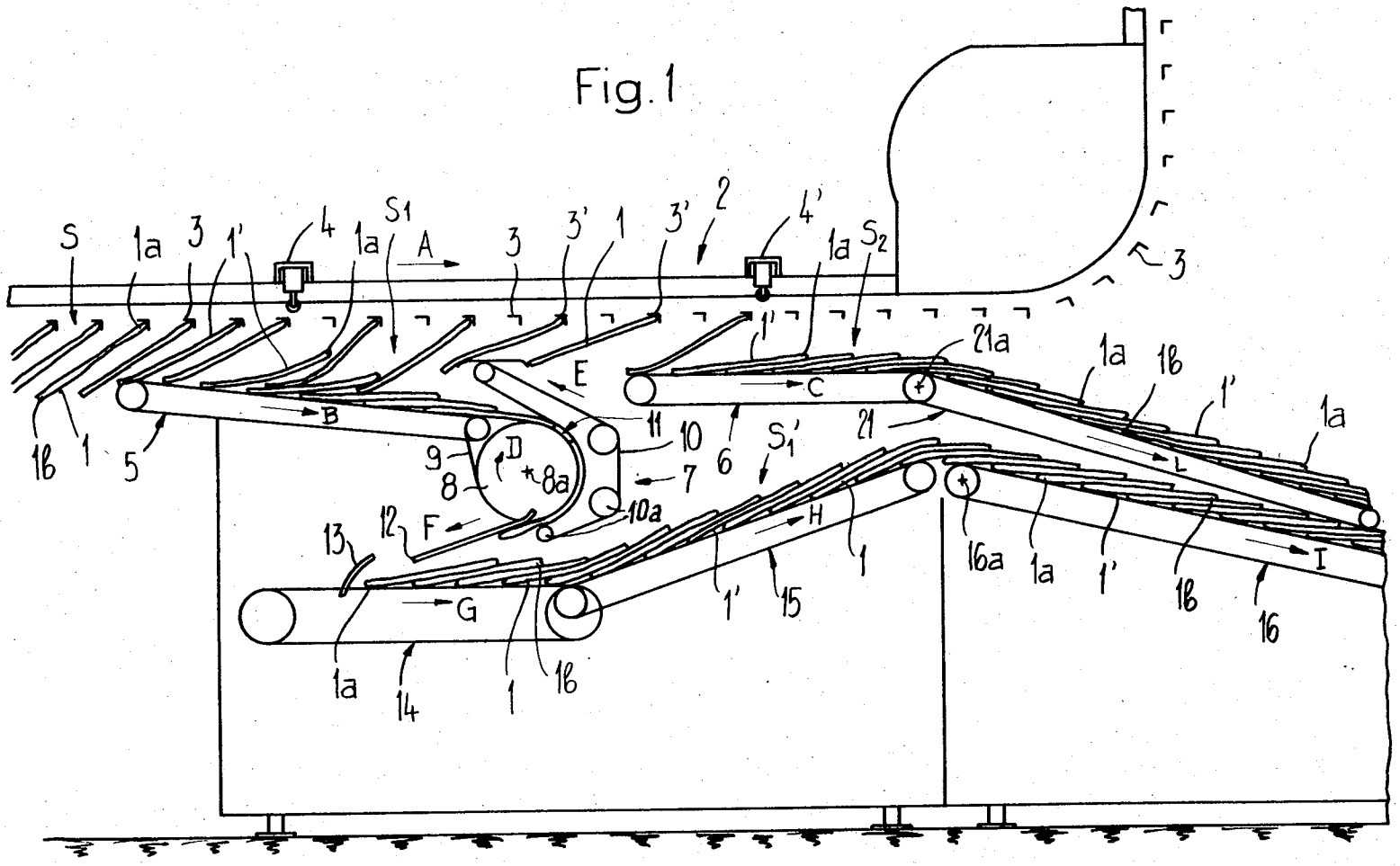
FIGS. 1 and 2 schematically show a first exemplary embodiment of an apparatus according to the invention for the intermediate storage of printed products.

Describing now the drawings, it is to be understood that to simplify the showing of the drawings only enough of the structure of the apparatus has been illustrated therein as is needed to enable one skilled in the art to readily understand the underlying principles and concepts of this invention. The illustrated exemplary embodiment of the apparatus for the intermediate storage of printed products or the like arriving in an imbricated product formation or stream will be seen to comprise a conveyor or transporter 2 which transports the printed products 1 or the like to be stored from a not particularly shown source, for instance from the delivery belt of a rotary printing press or rotogravure machine. The conveyor or transporter 2 is only schematically represented and is of a known type of construction described, for instance, in the U.S. Pat. No. 3,955,667, granted May 11, 1976.

The conveyor or transporter 2, whose direction of transport is designated with the reference character A, comprises controllable grippers or clamps 3 arranged sequentially in the transport direction A which grip or seize the printed products 1 at their leading edges 1*a*, which are as a rule the folded edges. Trailing edges 1*b* of the printed products lie opposite the leading edges 1*a* gripped by the grippers or clamps 3.

The grippers or clamps 3 are individually releasable. Opening devices 4 and 4', also of known construction, are provided for opening the grippers or clamps 3. These two opening devices 4 and 4' are arranged sequentially as seen in the transport direction A of the transporter or conveyor 2 and are also of conventional known type. The first opening device 4 is controlled such that only every other gripper or clamp 3 is released and the other grippers or clamps 3' are not affected. The latter grippers or clamps 3' are then opened by the rearmost opening device 4' to release the printed products 1.

Figure 3:
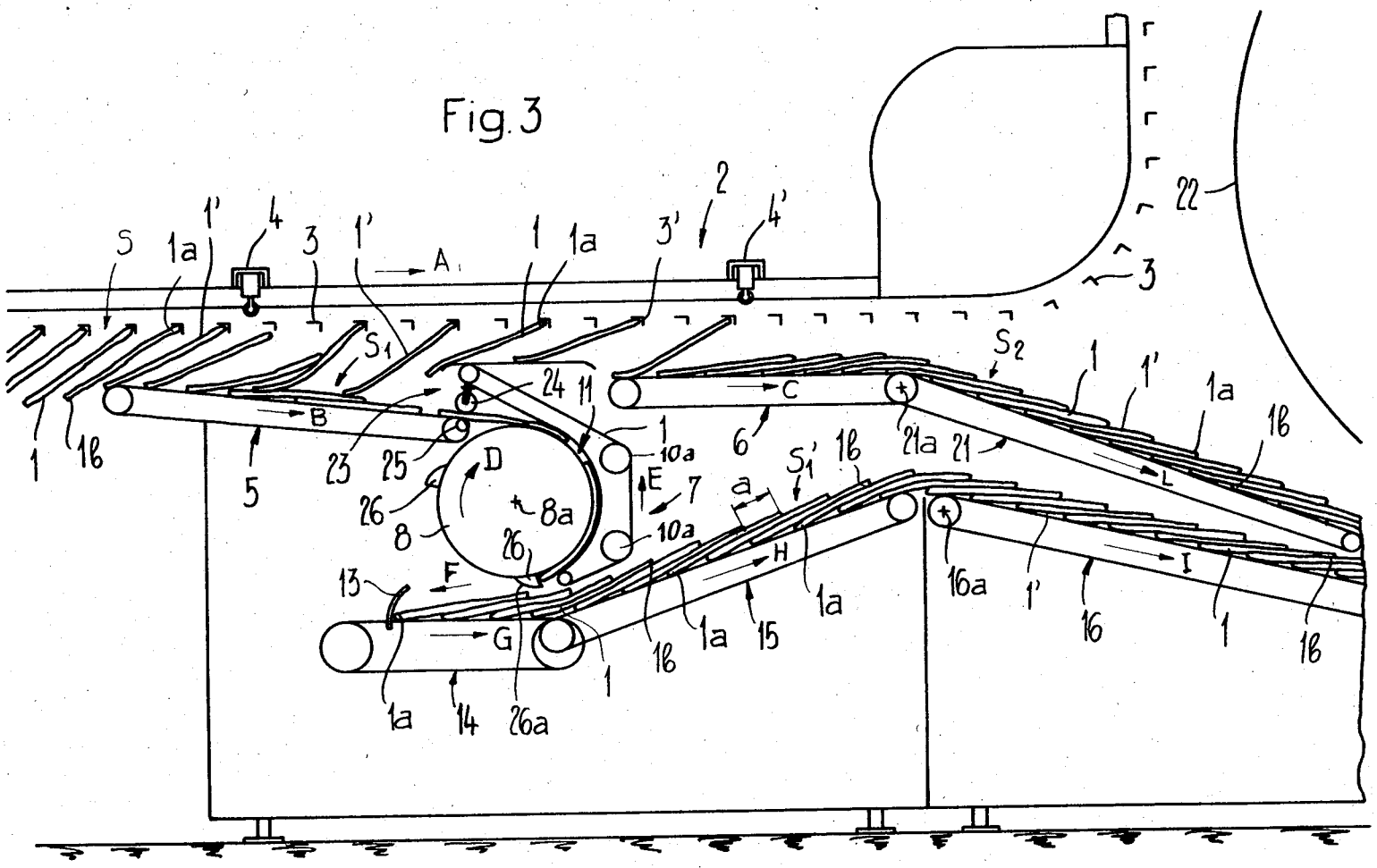
FIG. 3 schematically shows a further exemplary embodiment of a device for altering the position of the printed products within an imbricated product subformation.

As shown in FIGS. 1 and 3, belt conveyors 5 and 6 are arranged beneath the conveyor or transporter 2 and in the region of each opening device 4, respectively 4' and are driven in the direction of the arrows B and C by any suitable drive means. The belt conveyors 5 and 5' have substantially the same transport direction as the conveyor or transporter 2.

A turning or deflection apparatus 7, also forming a product inverting device and, in one embodiment of the invention, a separator or singling device as well, follows immediately downstream of the belt conveyor 5 and is arranged beneath the forward opening device 4 and comprises a deflection or turn guide roll 8 driven to rotate in the direction of the arrow D and whose axis of rotation 8*a* extends transverse and preferably substantially perpendicular to the transport direction B of the belt conveyor 5. At least one endless drive belt 9 runs over and suitably drives this turn guide roll 8. One leg or run of an endless counterbelt 10 is suitably driven to circulate over guide rolls 10*a* in the direction of the arrow E and along a portion of the circumference of the turn guide roll 8 to form a predetermined transport or conveying gap 11 between the turn guide roll 8 and the counterbelt 10.

A further belt conveyor 14 is arranged beneath the deflection or turning apparatus 7 whose transport direction is designated with the reference character G. A guide member 12 is arranged above this belt conveyor 14 immediately downstream of the outlet of the conveying gap 11. Furthermore, a fixed stop or abutment 13 is provided above the belt conveyor 14 and at a spaced distance from the outlet of the conveying gap 11 and in the extension of the path of motion of the printed products 1 leaving the conveying gap 11 determined by the guide member 12. A further belt conveyor 15 is arranged subsequent to the belt conveyor 14 and has a transport direction H with the same orientation.

A conveyor device 16 is located immediately downstream of the belt conveyor 15 and has a transport direction designated with the reference character I and corresponding to the transport direction H of the belt conveyor 15. This conveyor device 16 is constructed as a rocker or balance arm which is pivotable about a pivot axis or shaft 16*a* and comprises a conveyor belt or several conveyor belts arranged in parallel.

A not particularly shown actuating mechanism, such as that described in the previously mentioned U.S. Pat. No. 4,438,618, granted Mar. 27, 1984, engages this rocker or balance arm defining the conveyor device 16 to press it against a wind-up and storage unit 17 arranged immediately subsequent to the conveyor device 16 and whose construction is described in more detail in the commonly assigned U.S. patent application Ser. No. 06/432,557, filed Oct. 12, 1981. This winding and storage unit 16 comprises a mobile frame or support 18 in the form of a bearing pedestal in which the shaft 19 of a cylindrical winding mandril or core 20 is journaled. This shaft 19, respectively this winding mandril or core 20, is connected with not particularly shown suitable drive means which drives the winding mandril or core 19 in the direction of the arrow K, as is described in more detail in the previously mentioned U.S. Pat. No. 4,438,618, granted Mar. 27, 1984, to which reference may be readily had.

Figure 2:
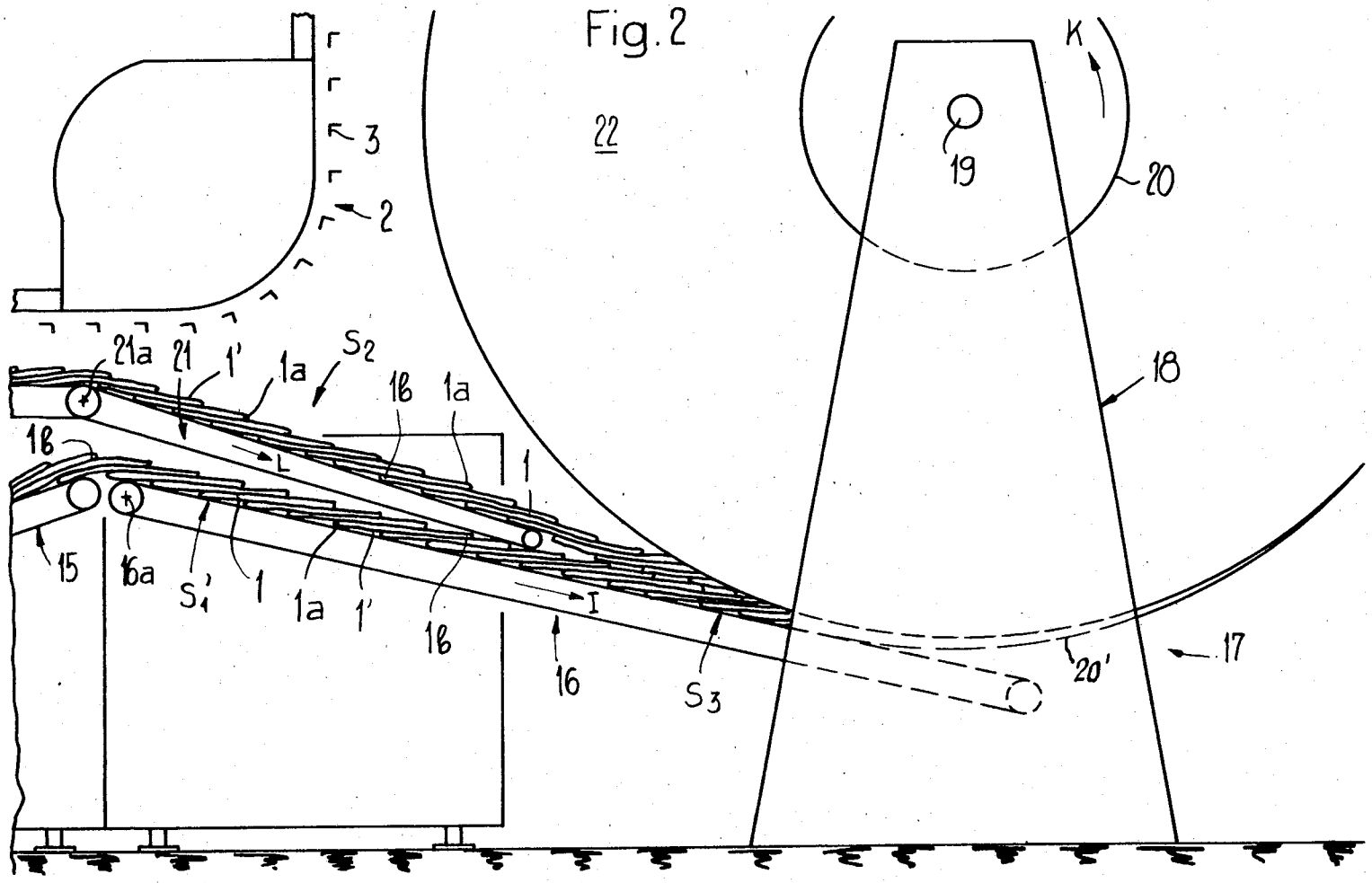

As is shown in the previously mentioned U.S. patent application Ser. No. 06/432,557, to which reference may be likewise had and the disclosure of which is incorporated herein by reference, a suitable supply drum or roll, not particularly shown in FIG. 2, is journaled in the frame or support 18 for a winding band or strap 20' which is fixedly connected with the winding mandril or core 20. This winding band or strap 20' can be placed under tension by means of any suitable tensioning device also not particularly shown, but for instance disclosed in the aforementioned U.S. Pat. No. 4,438,618.

A conveyor device 21 is arranged subsequent to the belt conveyor 6 associated with the rearmost opening device 4' and is also constructed as a balance or rocker arm pivotable about its axis 21*a* and comprising a conveyor belt or several adjacently arranged conveyor belts. The transport direction L of the conveyor device 21 corresponds to the transport direction C of the belt conveyor 6. The conveyor device 21 is arranged above the conveyor device 16 and terminates at a certain distance from the mobile frame 18, as can be seen in FIG. 2. The mechanism for adjusting the pivot or swing position of the conveyor device 21 in dependence of the pivot or swing position of the conveyor device 16 is not particularly illustrated in the drawings.

The manner of operation of the apparatus described in relation to FIGS. 1 and 2 is as follows:

As previously mentioned, when the grippers or clamps 3 and 3' of the conveyor or transporter 2 pass by the opening devices 4 and 4', respectively, these grippers or clamps 3 and 3' are alternatingly opened. The printed products 1 delivered in imbricated product formation S by the conveyor or transporter 2 are thus released and fall onto the belt conveyor 5, respectively 6, upon which they overlap one another in the manner of shingles and thereby form imbricated product subformations $S_1$ and $S_2$. The printed products 1 assume the same position or orientation in these subformations $S_1$ and $S_2$ as they did in the initially arriving or delivered imbricated product formation S, i.e. the same edges 1*a* of the printed products form the leading edges in the subformations as in the arriving formation. Both imbricated product subformations $S_1$ and $S_2$ are similar in that each printed product 1 overlies or overlaps a preceding printed product. The leading edges 1*a* of the printed products 1 are therefore exposed while the trailing edges 1*b* are each overlapped or covered over by the subsequent printed product 1.

The forward belt conveyor 5 conveys the imbricated product formation of printed products 1 to the inlet of the conveying gap 11 of the deflection or turning apparatus 7. As the printed products 1 enter this conveying gap 11, they are gripped or seized at their leading edges 1*a* by the deflection or turn guide roll 8, respectively by the drive belt 9 and the counterbelt 10, and are transported through the conveying gap 11. Since the deflection or turn guide roll 8 and the counterbelt 10 are driven at a speed which is higher than the transport speed of the belt conveyor 5, each gripped printed product 1 is accelerated and separated or singled, that is withdrawn from underneath the subsequent printed product, as will be seen in FIG. 1.

As the printed products 1 run through the conveying gap 11 they are also turned over or inverted. In the printed products 1 leaving the conveying gap 11, the edges 1*a* still form the leading edges but the sides 1' of the printed products 1 which were uppermost in the arriving imbricated product formation S now lie on the underside.

The individual printed products 1 exiting from the conveying gap 10 are transported underneath the guide member 12 against the stop 13 with a direction of motion F opposite to the transport direction B of the belt conveyor 5. After the printed products 1 impinge with their leading edges 1*a* upon the stop 13, they are deposited upon the belt conveyor 14, respectively upon the printed products 1 previously deposited thereupon. An imbricated product subformation $S_1'$ is formed upon this belt conveyor 14 whose transport direction G is opposite to the direction of motion F of the printed products 1 approaching the stop 13. In the imbricated product subformation $S_1'$, each printed product 1 overlies or overlaps the preceding printed product just as in the original imbricated product formation $S_1$. However, the leading edges 1*b* are now formed by that edge 1*b* which in the original imbricated product formation or stream S and also in the unaltered subformation $S_1$ formed the trailing edges and the sides 1' now lie on the underside. This altered imbricated product subformation $S_1'$ is transported by the belt conveyor 15 to the conveyor device 16.

The imbricated product subformation $S_2$ formed upon the belt conveyor 6 is also conducted to the conveyor device 16 by the conveyor device 21. As shown in FIG. 2, the subformation $S_2$ is now deposited upon the subformation $S_1'$ delivered by the conveyor device 16. The deposition of the subformation $S_2$ upon the subformation $S_1'$ is performed such that the subformations are laterally shifted, i.e. such that each subformation $S_1'$ and $S_2$ extends laterally beyond the other subformation with its edge region. By depositing the subformations $S_1'$ and $S_2$ in laterally shifted relationship, the later separation of these subformations is facilitated.

The double imbricated product formation $S_3$ formed by reuniting the subformations $S_1'$ and $S_2$ and which may be said to comprise two layers, is guided over the conveyor device 16 to the driven winding mandril or core 20, respectively to the product coil 22 forming thereupon, and is wound up from below conjointly with the previously mentioned winding band or strap 20' located on the underside of the double imbricated product formation $S_3$, as is explained in more detail in the previously mentioned U.S. Pat. No. 4,438,618.

Since, as has already been mentioned, the arriving imbricated product formation S is divided or split up into two subformations $S_1$ and $S_2$ which, after an alteration of the position or orientation of the printed products 1 in the subformation $S_1$, are mutually superposed and conjointly wound up, a delivery speed of the double imbricated product formation $S_3$, respectively the circumferential speed of the coil or wound product package 22, is required for processing all arriving printed products 1 which is only half as great as the transport speed of the conveyor or transporter 2. Due to the lower circumferential speed of the coil or wound product package 22, the loading of the coil or wound product package 22 and also of the winding and storage unit 17 is lower than it would be when directly winding up the arriving imbricated product formation S.

Since the leading edges **1*b* and 1*a* of the printed products 1 in the mutually superposed imbricated product subformations $S_1'$ and $S_2$ delivered from below and in "underfeed" as herein defined to the winding mandril or core 20, respectively to the coil or wound product package 22, lie upon the upper side of the respective imbricated product subformation $S_1'$ or $S_2$, i.e. are closer to the axis of rotation of the winding mandril than the trailing edges, the printed products come into contact with the storage coil or wound package 22 with these leading edges 1*b*, which fulfills the prerequisite for the ability of each layer of the product coil or package 22 formed by the double imbricated product formation $S_3$ to further rotate with respect to the next outer layer in the direction of rotation K during the winding operation without any mutual blocking or interference of adjacent layers or products. In this manner the coil or product package 22 can be further rotated from the interior in the manner of a clock spring which produces a compact coil or product package 22. For this reason, the properly oriented delivery of the printed products 1 to the winding mandril 20, respectively to the product coil or package 22** forming thereupon, is important.

The term "underfeed" as used herein is not to be understood as necessarily a feed from beneath, but as a feed in which the printed products enter into contact with the outer layer of the wound coil or product package with the leading edges, or stated in another way, a feed of the printed products such that the leading edges thereof are situated closer to the axis of rotation of the winding mandril than the trailing edges.

Altering the position or orientation of the printed products 1 of the first imbricated product subformation $S_1$ serves, however, another purpose. Due to the particular, previously mentioned position or orientation of the printed products 1 within the subformation $S_1'$, an imbricated product formation can again be obtained in which the printed products have the same position or orientation as in the original imbricated product formation S when the double imbricated product formation $S_3$ is unwound from the product coil or package 22 by simple means, e.g. by simply turning this imbricated product subformation $S_1'$. Such a turning over of the imbricated product subformation $S_1'$ when it is unwound from the coil 22 can be performed after separation from the other subformation $S_2$ with the aid of, for instance, a suitable inverting or turning device known per se and not particularly shown which substantially corresponds to the inverting or turning apparatus 7 but in which no separation or singling of the printed products 1 occurs.

The other subformation $S_2$ can, after separation from the subformation $S_1'$, be wound up to, for instance, an intermediate or transfer coil as is described in more detail in the U.S. patent application Ser. No. 06/445,564, filed Nov. 29, 1982, or the corresponding British Patent Publication No. 2,112,758 to which reference may be had for further details. In the imbricated product formation unwound from this intermediate or transfer coil, the printed products 1 assume the same position or orientation as in the original imbricated product formation S.

The apparatus shown in FIG. 3 corresponds to the apparatus shown in FIG. 1, with the exception of the construction of the deflection or turning apparatus 7. The same reference characters therefore have been generally used for mutually corresponding components of FIG. 1 and FIG. 3.

In the deflection or turning apparatus 7 according to FIG. 3, the separation or singling, i.e. the acceleration, of the printed products 1 is performed, not by the turn guide roll 7 and the counterbelt 10 during the passage of the printed products 1 through the conveying gap 11, but before their entry into this conveying gap 11 by an acceleration apparatus 23 which is arranged subsequent to the belt conveyor 5 and before the inlet into the conveying gap 11. This acceleration device 23 comprises at least a pair of acceleration rolls 24 and 25 suitably driven in not particularly shown manner, between which the printed products 1 run. Since these acceleration rolls 24 and 25 are driven to rotate with a circumferential or tangential speed which is greater than the transport speed of the preceding belt conveyor 5, the printed products 1 gripped by the acceleration rolls 24 and 25 are accelerated and withdrawn from beneath the respective subsequent printed product.

The separated or singled printed products traveling at the higher speed are conveyed to the conveying gap 11 in which they are gripped by the deflection or turn guide roll 8 and the counterbelt 10. The turn guide roll 8 has stop or positioning elements 26 distributed about its periphery and protruding in radial fashion therefrom.

The printed products 1 accelerated by the acceleration device 23 impinge with their leading edges **1*a* upon these stop or positioning elements 26, as can be seen in FIG. 3. The stop or positioning elements 26 are arranged in mutual spaced relationship along the peripheral or circumferential direction of the turn guide roll 8. The distance between them is somewhat greater than the length of the printed products 1 between their leading and trailing edges 1***a*, respectively 1*b*.

The fact that the distance or spacing between the leading edges 1*a* of sequential printed products 1 is determined by the spacing of the stop or positioning elements 26 assures that the imbricated product formation $S_1'$ formed upon the belt conveyor 14 has a constant imbrication distance (a). The stop or positioning elements 26 extending radially from the circumference of the turn guide roll 8 also assure that each printed product 1 leaving the conveying gap 11 does not collide with the preceding printed product which is in the process of depositing itself upon the belt conveyor 14 in that the stop or positioning elements 26 press this preceding printed product downward with their leading surfaces 26*a*.

The manner of operation of the deflection or turning apparatus 7 according to FIG. 3 otherwise corresponds to the manner of operation of the deflection or turning apparatus 7 according to FIG. 1.

Figure 4:
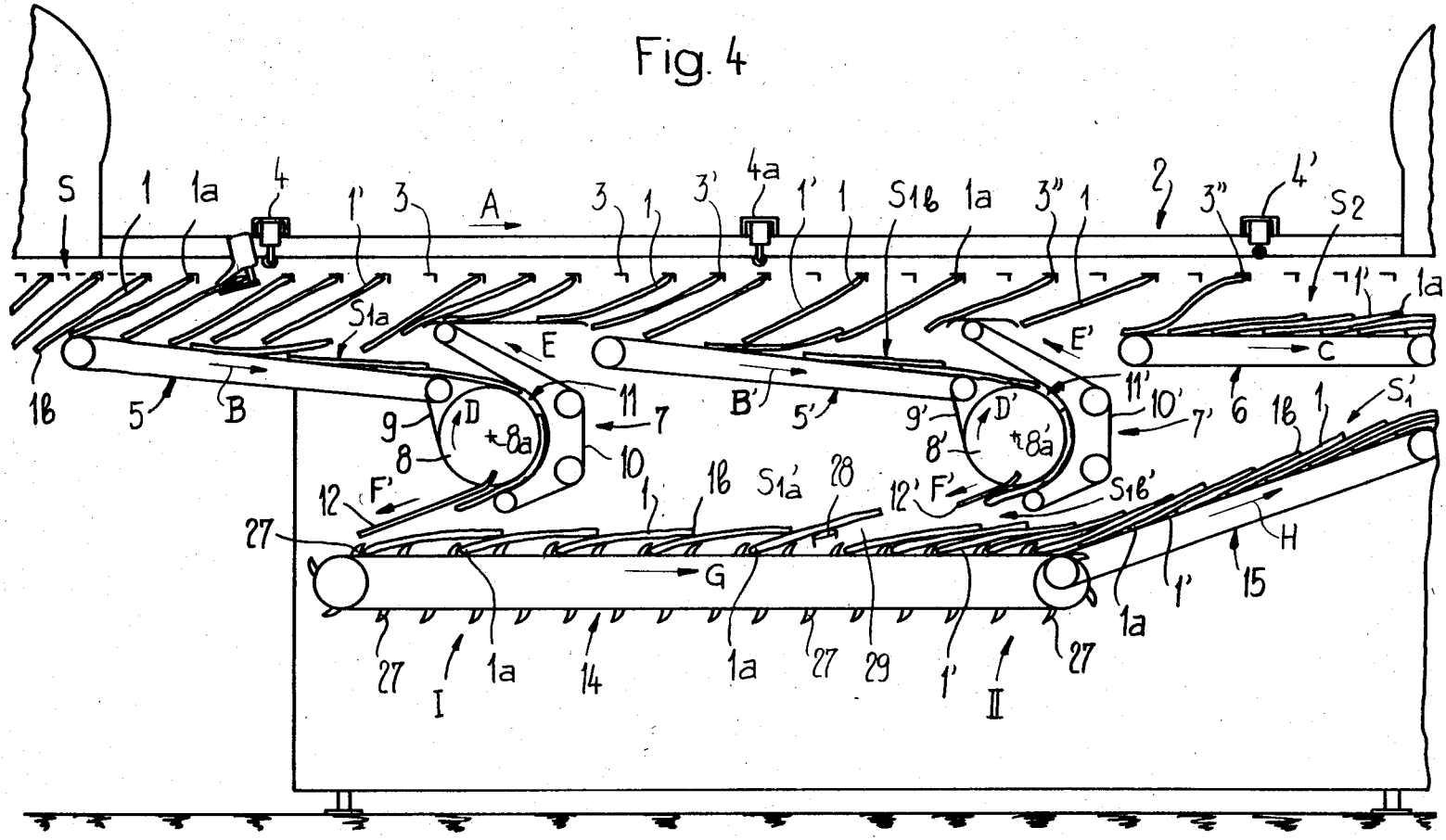
FIG. 4 schematically shows a further alternate embodiment of a device for altering the position of the printed products within an imbricated product subformation.

In contrast to the embodiments according to FIGS. 1 and 2, in the embodiment according to FIG. 4 there are two deflection or turning apparatuses 7 and 7' arranged sequentially in the transport direction A of the conveyor or transporter 2 and corresponding in construction and operation to the deflection or turning device 7 of FIG. 1.

A further belt conveyor 5' is arranged between the belt conveyors 5 and 6 leading to the second deflection or turning apparatus 7', as in the embodiment according to FIG. 1. A further opening device 4*a* for opening the grippers or clamps 3 is arranged above this belt conveyor 5'.

Both deflection or turning apparatuses 7 and 7' are mutually connected by the belt conveyor 14 arranged beneath the deflection or turning apparatuses 7 and 7'. This belt conveyor 14 comprises stop members 27 protruding outwardly in prescribed mutual spaced relationship and circulating therewith. These stop members 27 assume, among other things, the function of the stop 13 provided in the embodiment according to FIGS. 1 and 3 and therefore serve to form stop means for the printed products leaving the conveying gap 11, respectively 11' as well as to entrain the printed products 1.

The circulation or peripheral speed of the belt conveyor 14 and the distance between sequential stop members 27 are so related to the transport speed of the printed products 1 leaving the respective conveying gaps 11 and 11' respective deflection or turning apparatuses 7 and 7' that, in the region of the forward turning apparatus 7, the printed products 1 exiting from the conveying gap 11 are only transported to impinge against every second stop member 27, by which they are then entrained, while the printed products 1 leaving the conveying gap 11' of the rearmost deflection or turning apparatus 7' are transported to impinge upon the corresponding still unoccupied intermediate stop members 27 by which they are then entrained.

In order to make it possible to insert the last-mentioned printed products 1 between the other printed products 1 lying in imbricated but intermittent product formation upon the belt conveyor 14, a lifting or raising member 28 only schematically represented in the drawings is present ahead of the rearmost deflection or turning apparatus 7' as seen in the direction of motion G of the belt conveyor 14. The lifting or raising member 28 lifts or raises the printed products 1 already deposited upon the belt conveyor 14 in order to form an opening or gap 29 between sequential printed products 1 into which the printed products 1 exiting from the conveying gap 11' can be inserted.

The manner of operation of the apparatus according to FIG. 4 is as follows:

The gripper opening devices 4 and 4*a* which serve to release those printed products 1 from the arriving imbricated product formation S which form the subformations $S_1$, respectively $S_1'$, are controlled such that only every fourth gripper or clamp 3 is opened by the first, forward gripper opening device 4. The next gripper opening device 4*a* also opens only every fourth gripper or clamp 3', but ones which are spaced two grippers or clamps further away with respect to the forward opening device 4. The rear gripper opening device 4' effects the opening of the previously unreleased grippers or clamps 3''.

By releasing the grippers or clamps 3 and 3' as described, two imbricated product branch streams $S_{1a}$ and $S_{1b}$ are formed from the printed products 1 belonging to the first imbricated product subformation $S_1$, respectively $S_1'$. Each of these imbricated product branch streams $S_{1a}$ and $S_{1b}$ is conducted through the corresponding deflection or turning apparatus 7 or 7' in which a separation or singling and a turning over of the printed products 1 takes place by acceleration in the manner described in relation to FIGS. 1 and 2.

The printed products 1 leaving the deflection or turning apparatus 7, respectively 7', are transported to impinge against the stop members 27 of the belt conveyor 14 and are deposited upon the belt conveyor 14, respectively upon the printed products 1 from the arriving imbricated product branch stream $S_{1a}$, in the manner described to form a new, altered, imbricated product branch stream $S_{1a}'$.

The two imbricated product branch streams $S_{1a}'$ and $S_{1b}'$ are reunited upon the belt conveyor 14 serving as a collecting conveyor into a single altered imbricated product subformation $S_1'$ equivalent to the subformation $S_1'$ according to FIGS. 1 through 3. This subformation $S_1'$ is reunited in the manner described with the other subformation $S_2$ and wound up.

Since in the embodiment according to FIG. 4 the singling, turning and inverting functions are performed in two separate stations I and II and each station I and II has only to process half as many printed products 1 in comparison to the deflection or turning apparatus 7 according to FIGS. 1 and 3 for an equivalent arriving imbricated product subformation $S_1'$, the position-alteration of the printed products 1 in the deflection or turning apparatuses 7 and 7' can be carried out at a speed which is lower than the processing speed in the embodiments according to FIGS. 1 and 3, that is, which is only about half as great. This reduced throughput or processing speed of the printed products 1 by the deflection or turning apparatuses 7 and 7' therefore permits a flawless position-alteration of the printed products 1 without damage to the printed products even when the latter are supplied by the conveyor or transporter 2 at extremely high speed.

Of course, various components of the exemplary devices described can also be constructed other than as shown here. Only a few of the variously possible alternatives will be described in the following.

Deflection or turning apparatuses 7, 7' corresponding in construction and operation to the turning device 7 of FIG. 3 can also be employed instead of the deflection or turning apparatuses 7 and 7' corresponding to the deflection or turning apparatus 7 according to FIG. 1. It is furthermore conceivable to removably support the winding mandril 20 in a fixed bearing mount instead of a mobile frame or stand 18.

In all embodiments, the printed products 1 are accelerated and separated or singled, before or during running through the deflection or turning apparatus 7 and the stop members 13, respectively 27, are arranged at the outlet of the conveying gap 11. It is, however, also conceivable to turn or deflect the printed products 1 through 180° about an axis extending substantially at right angles to the product plane. This can be accomplished by, for instance, accelerating the printed products to separate or single them and then conveying them against a stop member and then to deposit them upon a conveyor belt located beneath the stop and whose transport direction is opposite to the direction of motion of the printed products 1 approaching the stop. This alternative embodiment has, however, the disadvantage that, in comparison to the embodiments shown, a somewhat greater structural expense is required.

While there are shown and described present preferred embodiments of the invention, it is to be distinctly understood that the invention is not limited thereto, but may be otherwise variously embodied and practiced within the scope of the following claims.

Accordingly, what I claim is:

1. A method for the intermediate storage of printed products arriving in imbricated product formation, such as newspapers, periodicals and the like, comprising the steps of:

conveying said printed products to a winding mandril;

dividing said arriving imbricated product formation of printed products into two imbricated product subformations;

altering the position of the printed products in one of said two imbricated product subformations such that edges of the printed products which trailed in the arriving imbricated product formation become leading edges in said one altered imbricated product subformation;

superposing the two imbricated product subformations;

subsequently winding up the two superposed imbricated product subformations conjointly such that the one altered imbricated product subformation is outermost in relation to said winding mandril and said altered leading edges, which were trailing edges in the arriving imbricated product formation, lie on a side of the one altered imbricated product subformation which is nearer to the winding mandril; and performing the winding of the printed products upon the winding mandril conjointly with a winding band maintained under tension and operatively connected with the winding mandril.

2. The method as defined in claim 1, wherein:

said printed products are conveyed to said winding mandril from below.

3. The method as defined in claim 1, wherein the position-altering step comprises the steps of:

extracting said printed products individually from said one imbricated product subformation; and subsequently redepositing the individually extracted printed products upon one another such that each printed product overlaps a preceding printed product in imbricated product formation and such that a leading edge of each printed product is formed by an edge thereof which was a trailing edge before being extracted.

4. The method as defined in claim 1, wherein:

in the position-altering step the imbricated product subformation is inverted such that an upper side thereof becomes an underside such that upper sides of the printed products become undersides thereof.

5. The method as defined in claim 1, further including the steps of:

forming at least two imbricated product branch streams from said printed products contained in said one imbricated product subformation;

altering said position of the printed products in each of said two imbricated product branch streams such that edges of the printed products which were trailing edges in said arriving imbricated product formation become leading edges; and subsequently reuniting the printed products of the two imbricated product branch streams to form an altered imbricated product subformation.

6. An apparatus for the intermediate storage of printed products arriving in imbricated product formation, such as newspapers, periodicals and the like, comprising:

a rotatably journaled and rotatably driveable winding mandril for winding up said printed products;

a conveyor device for delivering the printed products in imbricated product formation to said winding mandril;

a winding band capable of being placed under tension and operatively connected with the winding mandril for being entrained between coil layers of a package of printed products being wound up thereon;

means for dividing the arriving imbricated product formation into two imbricated product subformations and located forward of said conveyor device;

a position-altering device for altering the position of the printed products in one of the two imbricated product subformations which is more remote from said winding mandril such that edges of the printed products which were trailing edges in the arriving imbricated product formation become leading edges lying upon a side of the imbricated product subformation nearer the winding mandril; and means for subsequently superposing said two imbricated product subformations and located forward of said conveyor device.

7. The apparatus as defined in claim 6, wherein:

said conveyor device comprises conveyor means for delivering said printed products in imbricated product formation to said winding mandril from below.

8. The apparatus as defined in claim 6, wherein said position-altering device comprises:

means for extracting said printed products individually from said one imbricated product subformation of printed products and for subsequently superposing the printed products such that each printed product overlaps a preceding printed product and an edge of each printed product which was a trailing edge in the arriving imbricated product formation forms a leading edge.

9. The apparatus as defined in claim 8, wherein:

said printed products move along a predetermined travel path;

at least one separator device for imparting a higher speed to each printed product in relation to a subsequent printed product and defined by said position-altering device;

a stop device arranged in said travel path of the printed products against which the printed products which were separated by the at least one separator device impinge with said leading edges thereof;

the printed products approaching said stop device with a predetermined direction of motion; and a conveyor arranged beneath said stop devices and having a transport direction opposite to said predetermined direction of motion of the printed products.

10. The apparatus as defined in claim 6, wherein:

said position-altering device comprises at least one device for inverting said printed products of said one imbricated product subformation such that upper sides of the printed products become lower sides thereof.

11. The apparatus as defined in claim 10, wherein:

said printed products have a longitudinal direction of extent;

said position-altering device comprises means defining an axis extending substantially transverse to said longitudinal direction of extent of the printed products; and said at least one device for inverting comprises a turning apparatus for turning said printed products about said axis.

12. The apparatus as defined in claim 11, wherein:

said axis extends substantially perpendicular to said longitudinal direction of extent of the printed products.

13. The apparatus as defined in claim 11, wherein:

said turning apparatus comprises:

a driven turn guide roll having a circumference and being rotatable about said axis;

at least one endless circulating driven counterbelt extending along a portion of said circumference of said turn guide roll and forming conjointly with the turn guide roll a conveying gap to be traveled through by the printed products;

the printed products entering said conveying gap having a first direction of travel;

the printed products leaving said conveying gap having a second direction of travel; and said second direction of travel being opposite to said first direction of travel.

14. The apparatus as defined in claim 9, wherein:

said position-altering device includes a turning apparatus which comprises:

a driven turn guide roll having a circumference and being rotatable about said axis;

at least one endless circulating driven counterbelt extending along a portion of said circumference of said turn guide roll and forming conjointly with the turn guide roll a conveying gap to be traveled through by the printed products;

the printed products entering said conveying gap having a first direction of travel;

the printed products leaving said conveying gap having a second direction of travel;

said second direction of travel being opposite to said first direction of travel;

the printed products approaching the turning apparatus with a predetermined speed of motion;

the turn guide roll and said counterbelt being driven at a tangential speed greater than said predetermined speed of motion of the printed products approaching the turning apparatus; and said stop device being arranged subsequent to the turning apparatus.

15. The apparatus as defined in claim 9, wherein:

said position-altering device includes a turning apparatus which comprises:

a driven turn guide roll having a circumference and being rotatable about said axis;

at least one endless circulating driven counterbelt extending along a portion of said circumference of said turn guide roll and forming conjointly with the turn guide roll a conveying gap to be traveled through by the printed products;

the printed products entering said conveying gap having a first direction of travel;

the printed products leaving said conveying gap having a second direction of travel;

said second direction of travel being opposite to said first direction of travel;

the printed products approaching the turning apparatus with a predetermined speed of motion;

the turn guide roll being driven at a tangential speed greater than said predetermined speed of motion of the printed products approaching the turning apparatus; and said stop device being arranged subsequent to the turning apparatus.

16. The apparatus as defined in claim 9, wherein:

said position-altering device includes a turning apparatus which comprises:

a driven turn guide roll having a circumference and being rotatable about said axis;

at least one endless circulating driven counterbelt extending along a portion of said circumference of said turn guide roll and forming conjointly with the turn guide roll a conveying gap to be traveled through by the printed products;

the printed products entering said conveying gap having a first direction of travel;

the printed products leaving said conveying gap having a second direction of travel;

said second direction of travel being opposite to said first direction of travel;

the printed products approaching the turning apparatus with a predetermined speed of motion;

said counterbelt being driven at a tangential speed greater than said predetermined speed of motion of the printed products approaching the turning apparatus; and said stop device being arranged subsequent to the turning apparatus.

17. The apparatus as defined in claim 9, wherein:

said position-altering device includes a turning apparatus which comprises:

a driven turn guide roll having a circumference and being rotatable about said axis;

at least one endless circulating driven counterbelt extending along a portion of said circumference of said turn guide roll and forming conjointly with the turn guide roll a conveying gap to be traveled through by the printed products;

the printed products entering said conveying gap having a first direction of travel;

the printed products leaving said conveying gap having a second direction of travel;

said second direction of travel being opposite to said first direction of travel;

said at least one separator device being arranged forwardly of the turning apparatus;

the turn guide roll being provided with stop elements for engaging said leading edges of the printed products and distributed over the circumference of the turn guide roll; and said stop device being arranged subsequent to the turning apparatus.

18. The apparatus as defined in claim 17, wherein:

said at least one separator device is formed by at least one roll pair accommodating said printed products therebetween.

19. The apparatus as defined in claim 6, wherein:

said position-altering device comprises at least two sequentially arranged position-altering stations each capable of being supplied with a respective portion of the printed products associated with said one imbricated product subformation and each portion defining an imbricated product branch stream; and each of said at least two position-altering stations altering the position of the printed products of each said imbricated product branch stream such that edges of the printed products which were trailing edges in the arriving imbricated product formation become leading edges.

20. The apparatus as defined in claim 10, wherein:

said position-altering device comprises at least two sequentially arranged position-altering stations each capable of being supplied with a respective portion of the printed products associated with said one imbricated product subformation and each portion defining an imbricated product branch stream;

each of said at least two position-altering stations altering the position of the printed products of each said imbricated product branch stream such that edges of the printed products which were trailing edges in the original imbricated product formation become leading edges;

each of said two stations comprising a turning apparatus including means for extracting the printed products from a respective one of said imbricated product branch streams thereof;

the printed products leaving each said turning apparatus with a predetermined direction of motion;

a collecting conveyor arranged beneath both of said turning apparatuses and mutually connecting them; and said collecting conveyor having a transport direction opposite to said predetermined direction of motion of the printed products leaving the turning apparatuses.

21. The apparatus as defined in claim 20, wherein:

said collecting conveyor is provided with stop members arranged in mutual spaced relationship; and said printed products leaving said turning apparatuses impinging upon said stop members with said leading edges of the printed products.

22. The apparatus as defined in claim 20, further including:

means for forming openings between said printed products of a first one of said imbricated product branch streams and which printed products overlie one another in imbricated product formation on said collecting conveyor for inserting therebetween printed products of a second one of said imbricated product branch streams.

23. An apparatus for the intermediate storage of printed products arriving in imbricated product formation, such as newspapers, periodicals and the like, comprising:

a rotatably journaled and rotatably driveable winding mandril for winding up said printed products;

conveyor means for delivering the printed products in imbricated product formation to said winding mandril;

a winding band capable of being placed under tension and operatively connected with the winding mandril for being entrained between coil layers of a package of printed products being wound up;

means for dividing the arriving imbricated product formation into two imbricated product subformations and located forward of said conveyor means;

a position-altering device for altering the position of the printed products in one of the two imbricated product subformations such that edges of the printed products which were trailing edges in the arriving imbricated product formation become leading edges lying upon a side of the imbricated product subformation nearer the winding mandril; and means for subsequently superposing said two imbricated product subformations such that the one altered subformation will be wound up on the winding mandril in a layer located more remote therefrom than the other of said two subformations.

* * * * *

UNITED STATES PATENT AND TRADEMARK OFFICE

CERTIFICATE OF CORRECTION

PATENT NO. : 4,606,173

DATED : August 19, 1986

INVENTOR(S) : JACQUES MEIER

It is certified that error appears in the above—identified patent and that said Letters Patent is hereby corrected as shown below:

Column 9, line 49, after "11'" please insert --of the--

Signed and Sealed this

Twenty-third Day of December, 1986

*Attest:*

DONALD J. QUIGG

*Attesting Officer* *Commissioner of Patents and Trademarks*